US005641537A

United States Patent [19]

Ouyang et al.

[11] Patent Number: 5,641,537

[45] Date of Patent: *Jun. 24, 1997

[54] COMPOSITION FOR AND METHOD OF MONITORING DRIED-IN-PLACE NON-CHROME POLYACRYLAMIDE BASED TREATMENTS FOR METALS

[75] Inventors: Jiangbo Ouyang, Media; William L. Harpel, Langhorne, both of Pa.

[73] Assignee: BetzDearborn Inc., Trevose, Pa.

[ * ] Notice: The term of this patent shall not extend beyond the expiration date of Pat. No. 5,451,270.

[21] Appl. No.: 498,327

[22] Filed: Jul. 5, 1995

Related U.S. Application Data

[63] Continuation-in-part of Ser. No. 307,970, Sep. 16, 1994, Pat. No. 5,451,270, which is a continuation-in-part of Ser. No. 213,414, Mar. 15, 1994, Pat. No. 5,401,383.

[51] Int. Cl.[6] ..... C23C 22/00

[52] U.S. Cl. ..... 427/8; 148/241; 148/247; 148/251; 427/10

[58] Field of Search ..... 427/8–10; 148/241, 148/247, 251

[56] References Cited

U.S. PATENT DOCUMENTS

| | | | |
|---|---|---|---|
| 4,136,073 | 1/1979 | Muro et al. | 260/29.2 |
| 4,191,596 | 3/1980 | Dollman et al. | 148/247 |
| 5,122,202 | 6/1992 | Dykstra | 148/247 |
| 5,129,967 | 7/1992 | Sander | 148/247 |
| 5,158,622 | 10/1992 | Reichgott et al. | 148/247 |
| 5,401,333 | 3/1995 | Ouyang et al. | 148/241 |
| 5,451,270 | 9/1995 | Ouyang et al. | 148/241 |

*Primary Examiner*—Michael Lusignan

*Attorney, Agent, or Firm*—Alexander D. Ricci; Steven D. Boyd

[57] ABSTRACT

A process for measuring the coating weight of a dried-in-place non-chromate polyacrylamide based conversion coating is disclosed. An ammonium hexafluorotitanate tracer added to such a conversion coating was found to not adversely affect coating properties. The tracer was found to remain proportional to the polymer matrix when the coating was analyzed by X-ray fluorescence.

4 Claims, 1 Drawing Sheet

COMPOSITION FOR AND METHOD OF MONITORING DRIED-IN-PLACE NON-CHROME POLYACRYLAMIDE BASED TREATMENTS FOR METALS

This application is a continuation-in-part of application Ser. No. 08/307,970, filed Sep. 16, 1994, now U.S. Pat. No. 5,451,270, which is a continuation-in-part of application Ser. No. 08/213,414, filed Mar. 15, 1994, now U.S. Pat. No. 5,401,383.

FIELD OF THE INVENTION

The present invention relates generally to non-chrome coatings for metals. More particularly, the present invention relates to a method for monitoring the formation of a non-chrome conversion coating on metals such as galvanized metal, aluminum and aluminum alloys, zinc-aluminum galvanized metal (Galvalume®) and cold rolled steel. The method of the present invention provides a non-chrome coating for metal surfaces which yields excellent paint adhesion, corrosion resistance and boiling water performance which can be monitored by conventional X-ray fluorescence techniques.

BACKGROUND OF THE INVENTION

The purposes of the formation of a chrome conversion coating on metal surfaces are to provide corrosion resistance, improve adhesion of coatings and for aesthetic reasons. The conversion coating improves the adhesion of coating layers such as paints, inks, lacquers and plastic coatings. A chrome coating is typically provided by contacting a metal surface with an aqueous composition containing hexavalent or trivalent chromium ions, phosphate ions and fluoride ions. Typical chrome or chromate conversion coatings exhibit visible coloration ranging from gold to brown.

Growing concerns exist regarding the pollution effects of chrome and phosphate discharged into rivers and waterways by such processes. Because of the high solubility and the strongly oxidizing character of hexavalent chromium ions, conventional chrome conversion coating processes require extensive waste treatment procedures to control their discharge.

Chrome-free conversion coatings are known in the art. For example, U.S. Pat. No. 4,191,596 which was issued to Dollman et al. discloses a composition for coating aluminum which comprises a polyacrylic acid and $H_2ZrF_6$, $H_2TiF_6$ or $H_2SiF_6$. U.S. Pat. No. 4,921,552 which was issued to Sander et al. discloses a dried-in-place, non-chrome coating for aluminum. The coating composition consists essentially of $H_2ZrF_6$, a water soluble acrylic acid and homopolymers thereof and hydrofluoric acid.

U.S. Pat. No. 4,136,072 which was issued to Muro et al., discloses a composition and process for the pretreatment of aluminum surfaces using an aqueous acidic bath containing a stable organic film forming polymer and a soluble titanium compound. U.S. Pat. No. 5,158,622 which was issued to Reichgott et al. discloses a dried-in-place conversion coating for metal surfaces such as aluminum and aluminum alloys which employs an aqueous solution of water soluble maleic or acrylic acid/allyl ether copolymers alone or with an acid.

Most non-chrome pretreatments generate transparent coatings on metal surfaces. Furthermore, the lack of chrome makes actual coating weight measurements difficult. The coating weight of a chrome-based coating can be determined relatively easily by chrome X-ray fluorescence or chemical stripping and chemical titration of the coating. Non-chrome coatings may or may not be easily analyzed depending upon the materials present in the coating. For example, anionic polyacrylamide alone or in combination with a nonionic surfactant provides an effective metal pretreatment, however, such coatings are not readily analyzed.

SUMMARY OF THE INVENTION

The present invention provides a method of measuring the coating weight of a dried-in-place non-chrome polyacrylamide or polyacrylamide/surfactant based conversion coating. The method of the present invention involves the addition of an easily traced agent to a dried-in-place non-chrome conversion coating. The easily traced agent does not adversely affect the corrosion resistance or adhesion properties of the conversion coating. The easily traced agent is incorporated into the conversion coating treatment solution and remains proportional to the polymer matrix in the formed conversion coating. The present inventors discovered that ammonium hexafluorotitanate was readily soluble in polyacrylamide and polyacrylamide/surfactant based pretreatment solution; remained proportional to the polymer matrix in the dried-in-place conversion coating; did not adversely affect the properties of the conversion coating; and was easily measured by X-ray fluorescence.

As used herein, the term metal refers to galvanized metals (zinc surfaces), zinc-aluminum galvanized metals (Galvalume®) and cold rolled steel (iron surfaces). Galvalume is a registered trademark of Bethlehem Steel Corporation for a zinc-aluminum galvanized steel.

DESCRIPTION OF THE PREFERRED EMBODIMENTS

Figure 1:
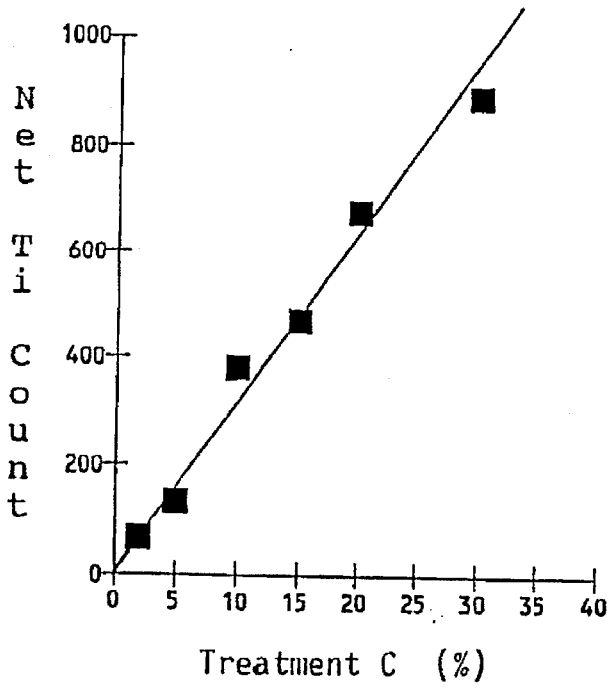
FIG. 1 is a plot of Ti counts (60 second accumulation) in X-Ray fluorescence vs. treatment solution concentration in %.

The present inventors have discovered a method of tracing the coating weight of a polyacrylamide-based dried-in-place conversion coating for metals without adversely affecting the properties of the coating. A tracer material is added to the conversion coating treatment solution. When a metal surface is treated, an amount of the tracer proportional to the amount of the treatment solution applied becomes a part of the conversion coating. The amount of tracer in the conversion coating can be easily measured, as by X-Ray fluorescence, and a standard plot used to determine the concentration of treatment material in the treatment bath.

The tracer material of the present invention does not adversely affect the conversion coating properties. The tracer material does not adversely affect paint adhesion, corrosion resistance or boiling water performance. The tracer material of the present invention exhibited a linear response in a plot of X-Ray fluorescence intensity versus treatment bath concentration. The tracer material did not evidence any solubility problems such as cloudiness or gel formation in the treatment bath.

The tracer material of the present invention is ammonium hexafluorotitanate. The present inventors discovered that when ammonium hexafluorotitanate was incorporated into a polyacrylamide or polyacrylamide/surfactant based conversion coating treatment solution, tracing of titanium in the formed conversion coating was relatively easy. The addition of ammonium hexafluorotitanate did not result in any adverse effects on the adhesion properties or corrosion resistance of the conversion coating. These results were unexpected in that the addition of ammonium hexafluorotitanate to other alkaline conversion coating treatments resulted in detrimental effects on the treatment solution. Also, when other titanium sources were incorporated into a polyacrylamide or polyacrylamide/surfactant based conversion coating solution problems of instability, non-linear response in X-Ray fluorescence testing or coating performance deterioration were noted.

The ammonium hexafluorotitanate tracer of the present invention is typically added to a polyacrylamide or polyacrylamide/surfactant based dried-in-place conversion coating treatment solution concentrate in concentrations ranging from about 0.1 to 10% by weight of the treatment solution. Preferably about 0.5% ammonium hexafluorotitanate is added. A typical poylacrylamide/surfactant based treatment solution concentrate can include from 0.05 to 20% polyacrylamide and from about 0.05 to 20% non-ionic surfactant. A typical polyacrylamide based treatment solution concentrate can include from about 0.05 to 20% polyacrylamide. The preferred polyacrylamide treatment concentrate comprises 2% anionic polyacrylamide of molecular weight 2,000 to 500,000. The acrylate/acrylamide ratio of the polymer molecule can range from 1:1 to 9:1.

The present invention will now be further described with reference to a number of specific examples which are to be regarded solely as illustrative and not as restricting the scope of the present invention.

In the following examples, the effects of the coating weight monitor on the treatment adhesion properties and corrosion resistance were evaluated with a variety of tests familiar to those skilled in the art. These tests included: "T-bend", the tendency for paint to disadhere from a 180° bend in the metal (0 T=perfect); "cross-hatch", the tendency of paint to disadhere from areas between closely spaced lines scribed through the paint; "T-bend/boiling DI water", the tendency for paint to crack or flower at a 180° bend in the metal after soaking in boiling DI water for 20 minutes (no paint cracking or flowering is considered a pass); "reverse Impact", the tendency for paint to disadhere from reverse impacted metal; "reverse impact/boiling DI water", the tendency for paint to disadhere from reverse impacted metal after boiling in DI water for 20 minutes; "acidic acid salt spray", per ASTM B-287 (10=perfect); "Neutral Salt Spray", per ASTM B-117 results are reported in millimeters lost in scribe (S), field (F), and edge (E) tests; "Pencil Hardness", "MEK Rubs", "Hot Humidity".

EXAMPLE 1

Various titanium sources were tested as tracers in a polyacrylamide/surfactant based pretreatment solution. Potassium hexafluorotitanate was found to have limited solubility in the treatment solution resulting in a non-linear response when analyzed by X-Ray fluorescence. A mixture of lactic acid titanate chelate ammonium salt (Tyzor-LA available from E. I. DuPont de Nemours, Wilmington, Dela.) in a polyacrylamide/surfactant based treatment solution generated intense titanium X-Ray fluorescence, however, the mixture became cloudy at 120° F. and particles formed which were suspended in the solution.

EXAMPLE 2

Ammonium hexafluorotitanate was tested as a tracer in a polyacrylamide/surfactant based pretreatment solution. The treatment was applied to Q-Panel 3003 aluminum test panels. The test panels were cleaned with a commercial alkaline cleaner (Betz Kleen® 4004, available from Betz Laboratories, Inc., Trevose, Pa.), rinsed with ambient tap water, squeegeed and spin coated with various concentrations of a polyacrylamide/surfactant pretreatment. The pretreatment comprised various dilutions of a concentrate of 1% anionic polyacrylamide (weight average molecular weight 2,000 to 500,000, acrylate/acrylamide ratio 1:1 to 9:1) 1% anionic surfactant (Triton X-100 available from Union Carbide) and 0.5% ammonium hexafluorotitanate. FIG. 1 is a plot of Ti counts (60 second accumulation) measured on a Portaspec (model 2501 ) X-ray spectrograph versus treatment solution concentration in DI water. The figure shows a linear relationship between concentration and Ti count as measured by X-Ray fluorescence.

EXAMPLE 3

The process described in Example 2 was used with a polyacrylamide/surfactant based pretreatment with and without ammonium hexafluorotitanate and Betz DC 1904, a chromium based pretreatment available from Betz Laboratories. Three polyester single coat paints were applied to the treated surfaces using a drawdown bar and cured according to the manufacturer's specifications. Table I summarizes the results showing that the polyacrylamide treatment with ammonium hexafluorotitanate tracer of the present invention provided comparable results to prior art chromium-based pretreatments. In Table I, Treatment A is Betz DC 1904, Treatment B is a polyacrylamide/surfactant based pretreatment without ammonium hexafluorotitanate and Treatment C is a solution in accordance with the present invention as described in Example 2.

TABLE I

| | | | | | | | AASS (500 hr) | |
|---|---|---|---|---|---|---|---|---|
| Treatment | TB* | TB/BW | RI | RI/BW | PENCIL | MEK | SCRIBE | FIELD |
| | | | PPG Polyester Paint | | | | | |
| 13.5% A | 0T | PASS | 10 | 10 | 3H | 100 | 9.5 | 10 |
| 10% B | 0T | PASS | 10 | 10 | 3H | 100 | 10 | 10 |
| 10% C | 0T | PASS | 10 | 10 | 4H | 100 | 10 | 10 |

TABLE I-continued

| Treatment | TB* | TB/BW | RI | RI/BW | PENCIL | MEK | AASS (500 hr) SCRIBE | AASS (500 hr) FIELD |
|---|---|---|---|---|---|---|---|---|
| | | | Lilly Polyester Paint | | | | | |
| 13.5% A | 0T | PASS | 10 | 2 | 2H | 100 | 8 | 8.5 |
| 10% B | 0T | PASS | 10 | 5 | 3H | 100 | 9.5 | 9 |
| 10% C | 0T | PASS | 10 | 7 | 4H | 100 | 8 | 8 |
| | | | Morton Polyceram Paint | | | | | |
| 13.5% A | 1T | PASS | 10 | 10 | 3H | 100 | 9.5 | 8 |
| 10% B | 1T | PASS | 10 | 10 | 4H | 100 | 7 | 7 |
| 10% C | 1T | PASS | 10 | 10 | 4H | 100 | 9.5 | 10 |

*TB: T-Bend
TB/BW: T-bend/Boiling water
RI: Reverse Impact, impact force: 40 in-lbs.
RI/BW: Revise Impact/Boiling water
AASS: Acetic Acid Salt Spray
MEK: Methyl ethyl ketone rubs

EXAMPLE 4

Tyzor-LA, in levels similar to Examples 1 to 3 above, was added to a polyacrylamide/surfactant based pretreatment. The solution became cloudy and a precipitate formed at temperatures of 120° and 140° F.

Ammonium hexafluorotitanate was added to a non-chromate treatment solution comprising an anionic polyacrylamide copolymer, an inorganic silicate and an organofunctional silane. The treatment solution became cloudy and gelled at room temperature overnight.

Examples 1–4 show that the combination of a polyacrylamide pretreatment and ammonium hexafluorotitanate tracer is unique in providing a pretreatment for aluminum which provides excellent paint adhesion and corrosion resistance and in which the coating weight can be easily measured by X-Ray fluorescence.

EXAMPLE 5

Figure 2:
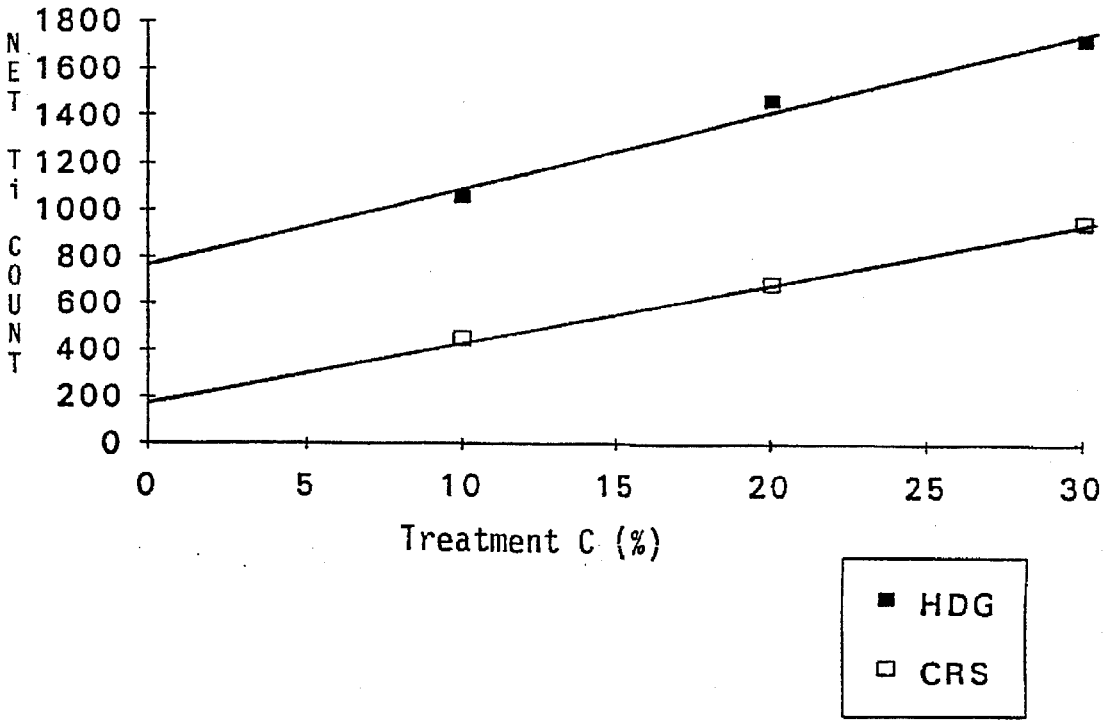
FIG. 2 is a plot of Ti counts (60 second accumulation) in X-Ray fluorescence vs. treatment solution concentration in %.

ACT G90 hot-dipped galvanized metal (HDG) and ACT cold rolled steel test panels were cleaned with an alkaline cleaner (Kleen 4010 available from Betz Laboratories), rinsed with ambient tap water, and squeegeed. The panels were then treated with a polyacrylamide/surfactant based pretreatment with ammonium hexafluorotitanate. Various concentrations of the pretreatment were used. Ti on the dried panels was measured with x-ray fluorescence. FIG. 2 shows a plot of net Ti counts (60 second accumulation) measured on a Portaspec (model 2501 ) X-ray spectrograph. FIG. 2 shows a linear relationship between treatment concentration and Ti count as measured by X-ray fluorescence.

EXAMPLE 6

Galvalume test panels from National Steel were cleaned with an alkaline cleaner (Kleen 4060 available from Betz Laboratories), rinsed with ambient tap water, and squeegeed. The panels were then treated, by spin-application, with a polyacrylamide/surfactant based pretreatment with ammonium hexafluorotitanate (Treatment C). An Akzo two-coat paint system was applied using drawdown bar immediately and four weeks after treatment. The paint application and curing was in accordance with the manufacturer's specifications. Dry adhesion, boiling water performances and neutral salt spray tests were conducted. A commercial chrome based pretreatment (Treatment D is PT 1500 available from Betz Laboratories, Inc.) was used as a control. Table II summarizes the results.

TABLE II

| Treatment | TB* | RI (in. lb) | RI/BW | Pencil Hardness | MEK | QCT (240 hr) | NSS (1000 hr) S | NSS (1000 hr) F | NSS (1000 hr) E |
|---|---|---|---|---|---|---|---|---|---|
| | | Immediate Painting | | | | | | | |
| 10% C | 1T | 120 | Fail | 3H | 100+ | 2 | 9 | 9 | 6 |
| 10% D | 3T | 88 | Fail | 3H | 100+ | 4 | 9 | 9 | 6 |
| | | 4 Week Delayed Painting | | | | | | | |
| 10% C | 2T | 110 | Fail | 3H | 100+ | 8 | 9 | 9 | 6 |
| 10% D | 3T | 80 | Fail | 3H | 100+ | 4 | 3 | 3 | 3 |

*TB: T-Bend
TB/BW: T-bend/Boiling water
RI: Reverse Impact, impact force: 40 in-lbs.
RI/BW: Revise Impact/Boiling water
NSS: Neutral Salt Spray
MEK: methyl ethyl ketone rubs Table II shows that the treatment of the present invention provided performances equivalent to or better than a chrome based pretreatment on Galvalume.

EXAMPLE 7

Cold rolled steel test panels from Erie Steel were processed as described in Example 6. The pretreatments were 10% Treatment C and 12% Treatment D, spin applied. Glidden Sanitary enamel paint (an epoxy phenolic urea) was applied using a drawdown bar and cured according to the manufacturer's specifications. Table III summarizes the test results.

TABLE III

| | Dry Adhesion on Cold Rolled Steel | | | |
|---|---|---|---|---|
| Treatment | Pencil Hardness | TB | MEK | RI (in/lb) |
| 10% C | 4H | 0T | 50+ | 80+ |
| 12% D | 4H | 0T | 50+ | 80+ |

Table III shows that the treatment of the present invention provided performance equivalent to a chrome based pretreatment on cold rolled steel.

EXAMPLE 8

Hot-dipped galvanized metal test panels from CFM were processed as described in Example 6. The pretreatments applied were 8% Treatment C or 10% Treatment D. The treated panels were painted with a Morton modified polyester/polycream two-coat system. Table IV summarizes the test results.

TABLE IV

| | Evaluation on CFM HDG | | | | | | |
|---|---|---|---|---|---|---|---|
| | | | | | NSS (1000 hrs) | | |
| Treatment | Pencil Hardness | MEK | TB | RI (in/lb) | S | F | E |
| 8% C | 3H | 100+ | 2T | 160+ | 7 | 2 | 20 |
| 10% D | 3H | 100+ | 2T | 160+ | 6 | 5 | 8 |

Table IV shows that the treatment of the present invention provided performance comparable to a chrome based pretreatment on hot-dipped galvanized metal.

EXAMPLE 9

Alumax 3004-H aluminum test panels were cleaned with an alkaline cleaner (Kleen 4010 available from Betz Laboratories), rinsed with ambient tap water, rinsed with DI water adjusted to pH 3 with phosphoric acid, and squeegeed. The panels were treated with a 10% polyacrylamide based pretreatment with ammonium hexafluorotitanate. Three paints were applied by drawn down bar in accordance with the manufacturer's specifications. Table V summarizes the test results.

TABLE V

| | | | | | NSS (1000 hrs) | |
|---|---|---|---|---|---|---|
| Paint | Pencil Hardness | MEK | RI (in/lb) | 750 hr. Humidity | Scribe | Field |
| Morton Polyester | 3H | 50+ | 48 | 10 | 7 | 8 |
| Lilly Polyester | 5H | 50+ | 48 | 10 | 8 | 10 |
| Lilly Two-Coat | 2H | 50+ | 48 | 10 | 5 | 8 |

Table V shows that a polyacrylamide based treatment of the present invention provides performance comparable to prior art chrome based pretreatments.

EXAMPLE 10

Cold rolled steel test panels were cleaned with an alkaline cleaner (Kleen 147 available from Betz Laboratories), rinsed with ambient tap water, treated with an iron phosphate treatment (DH 1947 available from Betz Laboratories), rinsed with ambient tap water, and treated with a 0.06% polyacrylamide based pretreatment with ammonium hexafluorotitanate. A ferro powder coating was applied in accordance with the manufacturer's specification. 700 hour hot-humidity testing gave a 10 rating. 500 hour neutral salt spray gave a rating of 6 scribe, 10 field.

EXAMPLE 11

Aluminum test panels were cleaned with an alkaline cleaner (DC-1675 available from Betz Laboratories), rinsed with tap water, squeegeed and treated with a 10% polyacrylamide based pretreatment with ammonium hexafluorotitanate. A clear and garnet red paint were applied by draw down bar in accordance with the manufacturer's specifications. Table VI summarizes the results.

TABLE VI

| Paint | MEK | Cross-Hatch | NSS 1,000 hrs. | |
|---|---|---|---|---|
| Color | Rubs | Boiling Water | Scribe | Field |
| Clear | 100 | 4B | 9.5 | 10 |
| Red | 100 | 4.5B | 10 | 10 |

While the present invention has been described with respect to particular embodiments thereof, it is apparent that numerous other forms and modifications of the invention will be obvious to those skilled in the art. The appended claims and this invention generally should be construed to cover all such obvious forms and modifications which are within the true scope and spirit of the present invention.

We claim:

1. A process for monitoring the coating weight of an anionic polyacrylamide based metal treatment comprising:

a. adding ammonium hexafluorotitanate in concentrations ranging from 0.1 to 10% by weight of treatment to an anionic polyacrylamide based treatment solution in an amount sufficient to allow detection;

b. treating a metal surface with said combination;

c. subjecting the treated surface to X-Ray fluorescence to detect titanium in the coating wherein titanium detected by X-Ray fluorescence is proportional to the coating weight.

2. The process of claim 1 wherein said metal is selected from the group comprising aluminum, cold rolled steel, zinc, galvanized metal and zinc-aluminum galvanized metal.

3. An aqueous solution for coating a metal surface consisting essentially of an anionic polyacrylamide copolymer, and ammonium hexafluorotitanate.

4. The aqueous solution of claim 3 wherein said anionic polyacrylamide is present in a concentration of from about 0.05% to 2% and the ammonium hexafluorotitanate is present in a concentration of from about 0.1 to 10%.

* * * * *